US006690116B2

(12) United States Patent
Song et al.

(10) Patent No.: US 6,690,116 B2
(45) Date of Patent: Feb. 10, 2004

(54) HIGH-RESOLUTION FIELD EMISSION DISPLAY

(75) Inventors: Yoon-Ho Song, Taejon (KR); Young-Rae Cho, Taejon (KR); Seung-Youl Kang, Taejon (KR); Moon-Youn Jung, Taejon (KR); Chi-Sun Hwang, Taejon (KR); Jin-Ho Lee, Taejon (KR); Kyoung-Ik Cho, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 340 days.

(21) Appl. No.: 09/872,285

(22) Filed: May 31, 2001

(65) Prior Publication Data

US 2002/0080099 A1 Jun. 27, 2002

(51) Int. Cl.[7] ..... G09G 3/10
(52) U.S. Cl. ..... 315/169.3; 313/497
(58) Field of Search ..... 315/169.3, 169.1; 313/497, 495, 489, 309

(56) References Cited

U.S. PATENT DOCUMENTS

| | | | | | |
|---|---|---|---|---|---|
| 5,015,912 | A | | 5/1991 | Spindt et al. | 313/495 |
| 5,229,682 | A | * | 7/1993 | Komatsu | 313/309 |
| 5,402,041 | A | | 3/1995 | Kishino et al. | 315/169.1 |
| 5,448,133 | A | * | 9/1995 | Ise | 315/169.4 |
| 5,616,991 | A | | 4/1997 | Casper et al. | 315/167 |
| 6,417,605 | B1 | * | 7/2002 | Hofmann et al. | 313/309 |
| 6,476,548 | B2 | * | 11/2002 | Xia | 313/497 |
| 6,489,726 | B2 | * | 12/2002 | Xia | 315/169.2 |

OTHER PUBLICATIONS

Baptist, R. et al., "Microtips and Resistive Sheet: A Theoretical Description of the Emissive Properties of this System," *in Proceedings of the 9th International Vacuum Microelectronics Conference*, St. Petersburg, 1996, pp.19–23.

* cited by examiner

*Primary Examiner*—James Clinger
*Assistant Examiner*—Ephrem Alemu
(74) *Attorney, Agent, or Firm*—Seed IP Law Group PLLC

(57) ABSTRACT

A high-resolution field emission display that applies a field emission device (or a field emission array) being an electron source element to a flat panel display device. The field emission display includes an upper plate and a lower plate that face each other, wherein the lower plate and the upper plate are vacuum-packaged in parallel positions. A dot pixel of the lower plate includes a high-voltage amorphous silicon thin film transistor formed on the glass substrate of the lower plate, a diode type field emission film partially formed on the drain of the high-voltage amorphous silicon TFT, a passivation insulation layer formed on the high-voltage amorphous silicon TFT and the lateral side of the diode type field emission film, and an electron beam focusing electrode/light-shading film which vertically overlaps with the high-voltage amorphous silicon TFT on some parts of the passivation insulation layer and is formed on a lateral side of the diode type field emission film. A dot pixel of the upper plate includes a transparent electrode formed on the glass substrate of the upper plate, and a red, green or blue phosphor formed on some parts of the transparent electrode. Therefore, the high-resolution field emission display device can obtain an effect of focusing the electron beam trajectory and a light-shading effect for the TFT at the same time, and thus remarkably enhance the performance and the resolution of the field emission display.

10 Claims, 6 Drawing Sheets

HIGH-RESOLUTION FIELD EMISSION DISPLAY

TECHNICAL FIELD

The present invention relates to a high-resolution field emission display. More particularly, it relates to a high-resolution field emission display for applying a field emission device (or a field emission array) being an electron source element to a flat panel display device.

BACKGROUND OF THE INVENTION

Field emission display devices are manufactured by making a vacuum-packaging between a lower plate having field emitter arrays and a upper plate having phosphors positioned within a small distance, e.g., 2 mm from the lower plate. The field emission display device generates cathode luminescence by colliding electrons emitted from field emitters of the lower plate against phosphors of the upper plate, thereby achieving an image display. Recently, the field emission display devices have been widely developed as a flat panel display substituting for conventional cathode ray tube (CRT).

The field emitter serving the most important function of the lower plate of the field emission display device has different electron emission efficiency according to the structure, emitter material, and emitter shape. At present, there are two kinds of field emission elements, those are, diode type device comprised of a cathode (or emitter) and an anode, and triode type device comprised of a cathode, a gate and an anode. Several materials such as metal, silicon, diamond, diamond-like carbon, or carbon nanotube have been used as the emitter material. In general, metal and silicon are used for the triode type device, and diamond-like carbon or carbon nanotube are used for the diode type structure. The diode type field emitter has a disadvantage in the control characteristic of the electron emission and high voltage driving characteristic, as compared to the triode type field emitter. But, the manufacturing process of the diode type field emitter is relatively easier than that of the triode type field emitter, so that large-sized devices can be easily manufactured.

In the meantime, field emission display device is classified into simple matrix panel type and active matrix panel type, according to the pixel arrangement of the lower plate in a matrix format. The simple matrix field emission display forms each pixel with a field emitter array only, whereas the active matrix field emission display forms each dot pixel with a field emitter array and a semiconductor device (mainly, a transistor) controlling the field emission current of the field emitter array.

FIGS. 1–3 are cross-sectional views illustrating one dot pixel of a conventional field emission display device. FIG. 1 is a cross-sectional view illustrating a dot pixel structure of a simple matrix field emission display device consisting of a conventional triode type field emitter array.

Referring to FIG. 1, the conventional field emission display device includes a lower plate and a upper plate facing to each other, wherein the lower plate and the upper plate are vacuum-packaged. The lower plate includes a glass substrate 101, a cathode electrode 102 made of metal deposited on the glass substrate 101, a resistance layer 103 made of doped amorphous silicon on the cathode electrode 102, a cone-type field emission tip 104 made of a metal (mainly, molybdenum), which is partially deposited on the resistance layer 103, and a gate insulation layer 105 and a gate electrode 106 which are used to apply electric field to the field emission tip 104. The upper plate includes a glass substrate 121, a transparent electrode 122 formed on the glass substrate 121, a red, green, or blue phosphor 123 partially formed on the transparent electrode 122.

The field emission display of FIG. 1 has an advantage of inducing reliable field emission at a relatively low voltage (generally, 80 V), but the field emission display has a limitation in manufacturing field emission tips in large-sized plate and requires a high field emission voltage.

FIG. 2 is a cross-sectional view illustrating a dot pixel structure of a simple matrix field emission display device comprised of a conventional diode type field emission element.

Referring to FIG. 2, a conventional field emission display device includes a lower plate and a upper plate facing to each other, wherein the lower plate and the upper plate are vacuum-packaged. The lower plate includes a glass substrate 201, a cathode electrode 202 made of metal deposited on the glass substrate 201, a resistance layer 203 made of doped amorphous silicon on the cathode electrode 202, and a diode type field emission film 204 made of carbon nanotube, which is partially formed on the resistance layer 203. The upper plate includes a glass substrate 221, a transparent electrode 222 formed on the glass substrate 221, a red, green, or blue phosphor 223 partially formed on the transparent electrode 222.

The field emission display device of FIG. 2 has a simple structure and facilitates the fabrication process, but the field emission display device requires a high field emission voltage and has unstable field emission characteristic and relating low an uniformity and reliability.

FIG. 3 is a cross-sectional view illustrating a dot pixel structure of an active matrix field emission display device comprised of a conventional diode type field emission element and a polycrystalline silicon thin film transistor (TFT).

Referring to FIG. 3, a conventional field emission display device includes a lower plate and a upper plate facing to each other, wherein the lower plate and the upper plate are vacuum-packaged. The lower plate includes a glass substrate 301; a TFT's channel 302 made of undoped polycrystalline silicon; TFT's source 303 and drain 304 made of doped polycrystalline silicon on both sides of the TFT's channel 302; a gate insulation layer 305 made of silicon oxide ($SiO_2$) layer, which is deposited on the channel 302, the source 303 and the drain 304 of TFT; a first gate 306 which is formed on some parts of the gate insulation layer 305 to vertically overlap with some portions of the TFT's source 303 and the TFT's channel 302, and not overlap with the TFT's drain 304; a passivation insulation layer 307 made of a silicon oxide layer, which is formed on the first gate 306; a second gate 308 which is formed on some portions of the passivation insulation layer 307 to vertically overlap with some parts of the TFT's channel 302 and the TFT's drain 304; and a diode type field emission film 309 formed of carbon nanotube, which is formed to be electrically connected to the TFT's drain 304 by partially removing the gate insulation layer 305 and the passivation insulation layer 307 that are formed on the TFT's drain 304. The upper plate includes a glass substrate 321, a transparent electrode 322 formed on the glass substrate 321, a red, green, or blue phosphor 323 partially formed on the transparent electrode 322.

The field emission display device of FIG. 3 can remarkably restrict the cross-talk a display signal because each dot pixel is electrically isolated by a polycrystalline silicon thin film transistor. In addition, since the field emission current is controlled by the polycrystalline silicon thin film transistor, the field emission display device can be driven at a low voltage and can achieve very stable electron emission characteristic. However, the field emission display of FIG. 3 has a difficulty in manufacturing a large-sized field emission display device because a process for making a polycrystalline silicon thin film transistor should be added to the manufacturing process of the field emission display device of FIG. 3, and therefore the production cost becomes very expensive.

In the meantime, conventional field emission displays shown in FIGS. 1–3 have a difficulty in manufacturing a high-resolution display device, because spreading of electron beam occurs when the electron beam emitted from the field emission element is applied on the phosphor. Accordingly, in order to prevent such spreading of electron beam, an additional focusing electrode should be needed to the conventional field emission display devices.

SUMMARY OF THE INVENTION

Accordingly, the present invention is directed to a high-resolution field emission display that substantially obviates one or more of the problems due to limitations and disadvantages of the related art.

It is an object of the present invention to provide a high-resolution field emission display which replaces a polycrystalline silicon thin film transistor used as a control/switching element of a field emission current in an active matrix field emission display device with an amorphous silicon thin film transistor (TFT). By doing so, it is impossible to make a large-sized active matrix field emission display device, and restrict TFT's optical leakage current due to the photoelectric characteristic of amorphous silicon and obtain an effect of focusing the emitted electron beam.

To achieve these and other advantages and in accordance with the purpose of the present invention, as embodied and broadly described, includes a field emission display including a lower plate having electron source dot pixels formed a diode type field emission film in a matrix arrangement and an upper plate having phosphor dot pixels, the lower plate and the upper plate being vacuum packaged in parallel positions, and including a transistor for driving field emission of each electron source dot pixel, and further including an electron beam focusing electrode/light-shading film being arranged to partially enclose the region of the lower plate where the field emission film is formed, and focusing the electron beam emitted from the electron source dot pixel so as to accurately direct the electron beam to the phosphor dot pixel in the upper plate, and preventing the light emitted from the phosphor of the upper plate from being irradiated on the channel of the transistor of the lower plate.

In another aspect, a transistor is provided that is suitable to a field emission display including a lower plate having a field emission film being an electron source and a upper plate having a phosphor collided by an electron beam emitted from the field emission film, the transistor includes: a substrate properly used as the lower plate; a gate made of a metal thin film formed on a part of the lower plate; a gate insulation layer made of a silicon nitride film deposited on the lower plate including the gate; a channel made of amorphous silicon deposited on the gate insulation layer and positioned over at least a part of the gate; a source made of doped amorphous silicon deposited on the channel and positioned over at least a part of the gate; a drain made of doped amorphous silicon deposited on the channel and having a lateral side opposing a lateral side of the source and positioned at a location offset from the gate in a lateral direction; a source electrode made of a metal thin film deposited on the source; and a drain electrode made of a metal thin film deposited on the drain, wherein the drain electrode is extended to provide a substrate for forming the electron source dot pixel, and is deposited on the lower plate Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The embodiments of the present invention will be explained with reference to the accompanying drawings, in which.

DETAILED DESCRIPTION OF THE INVENTION

Reference will now be made in detail to the preferred embodiments of the present invention, examples of which are illustrated in the accompanying drawings.

Figure 1:
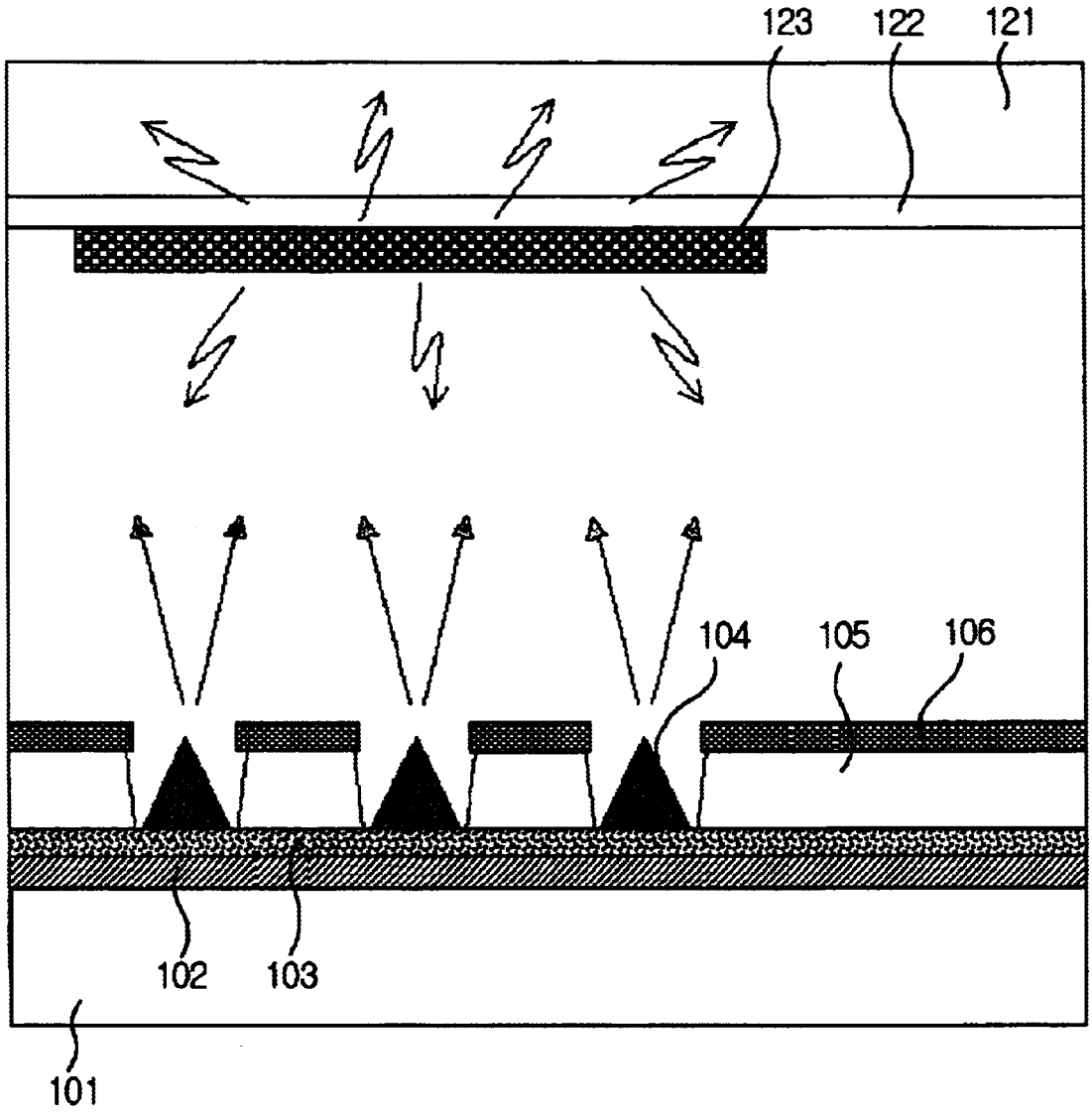
FIG. 1 Prior Art
FIG. 1 is a cross-sectional view illustrating a dot pixel structure of a simple matrix field emission display device consisting of a conventional triode type field emitter array.
Figure 2:
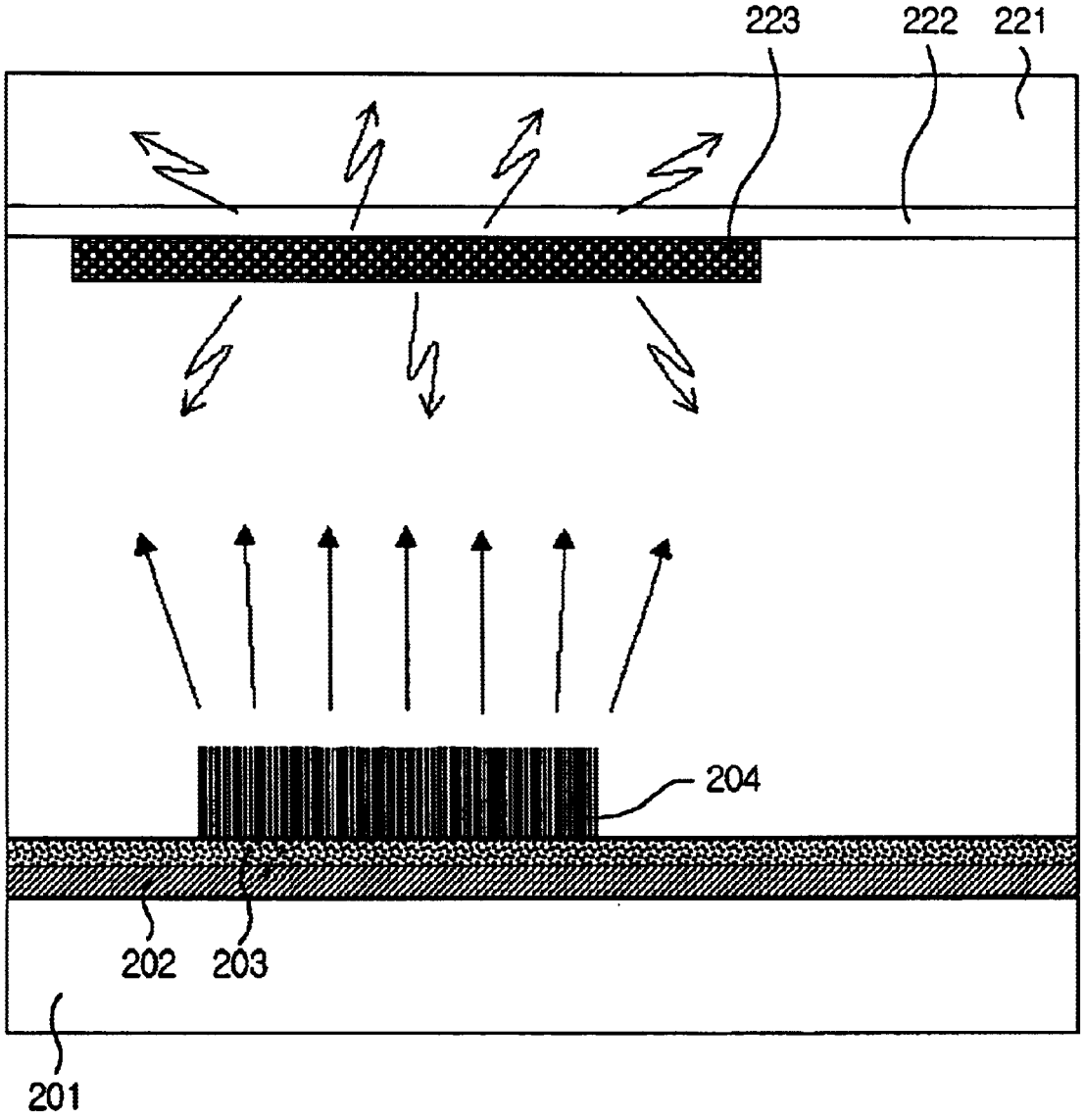
FIG. 2 Prior Art
FIG. 2 is a cross-sectional view illustrating a dot pixel structure of a simple matrix field emission display device comprised of a conventional diode type field emission element.
Figure 3:
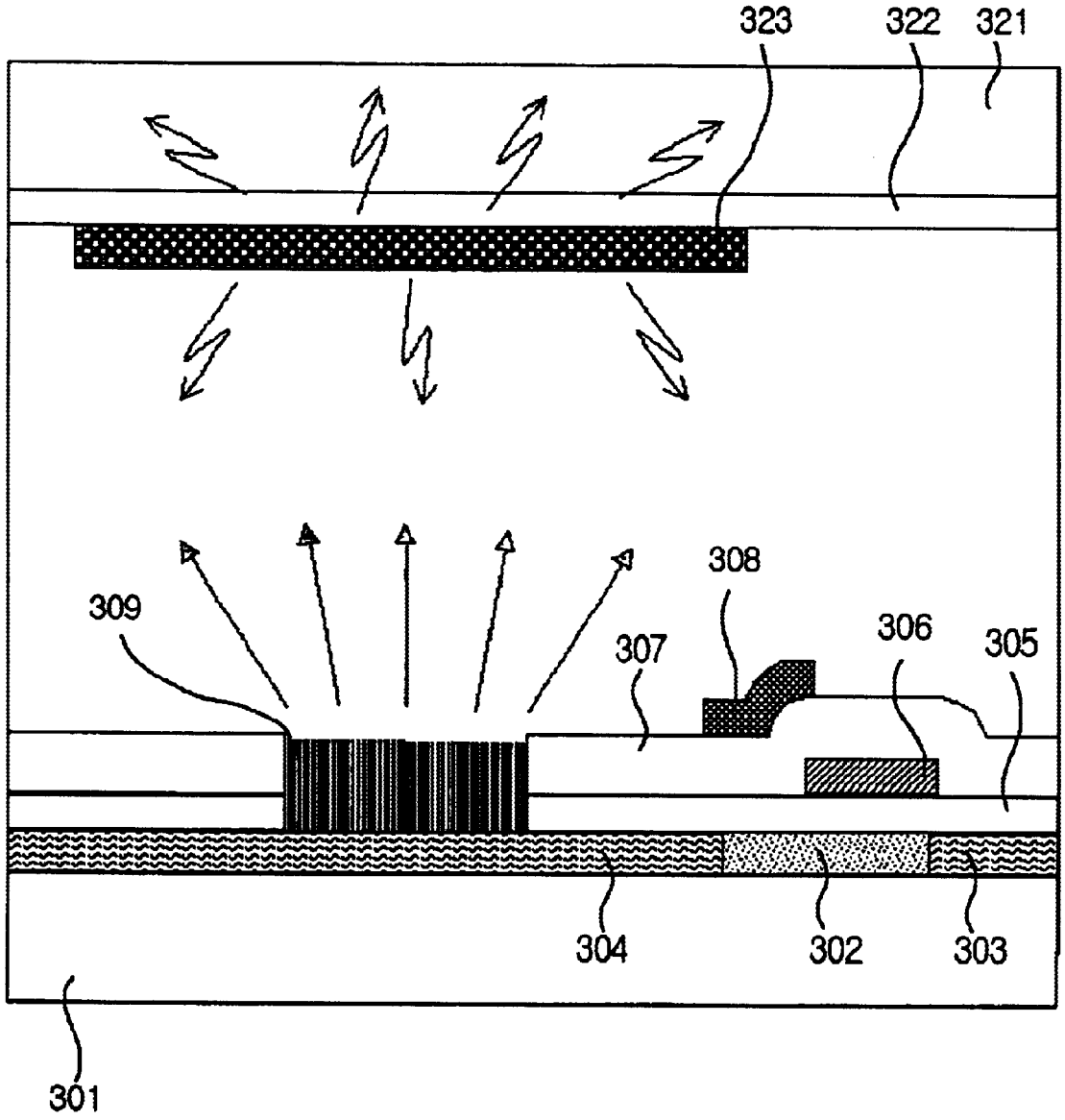
FIG. 3 Prior Art
FIG. 3 is a cross-sectional view illustrating a dot pixel structure of an active matrix field emission display device comprised of a conventional diode type field emission element and a polycrystalline silicon thin film transistor.
Figure 4:
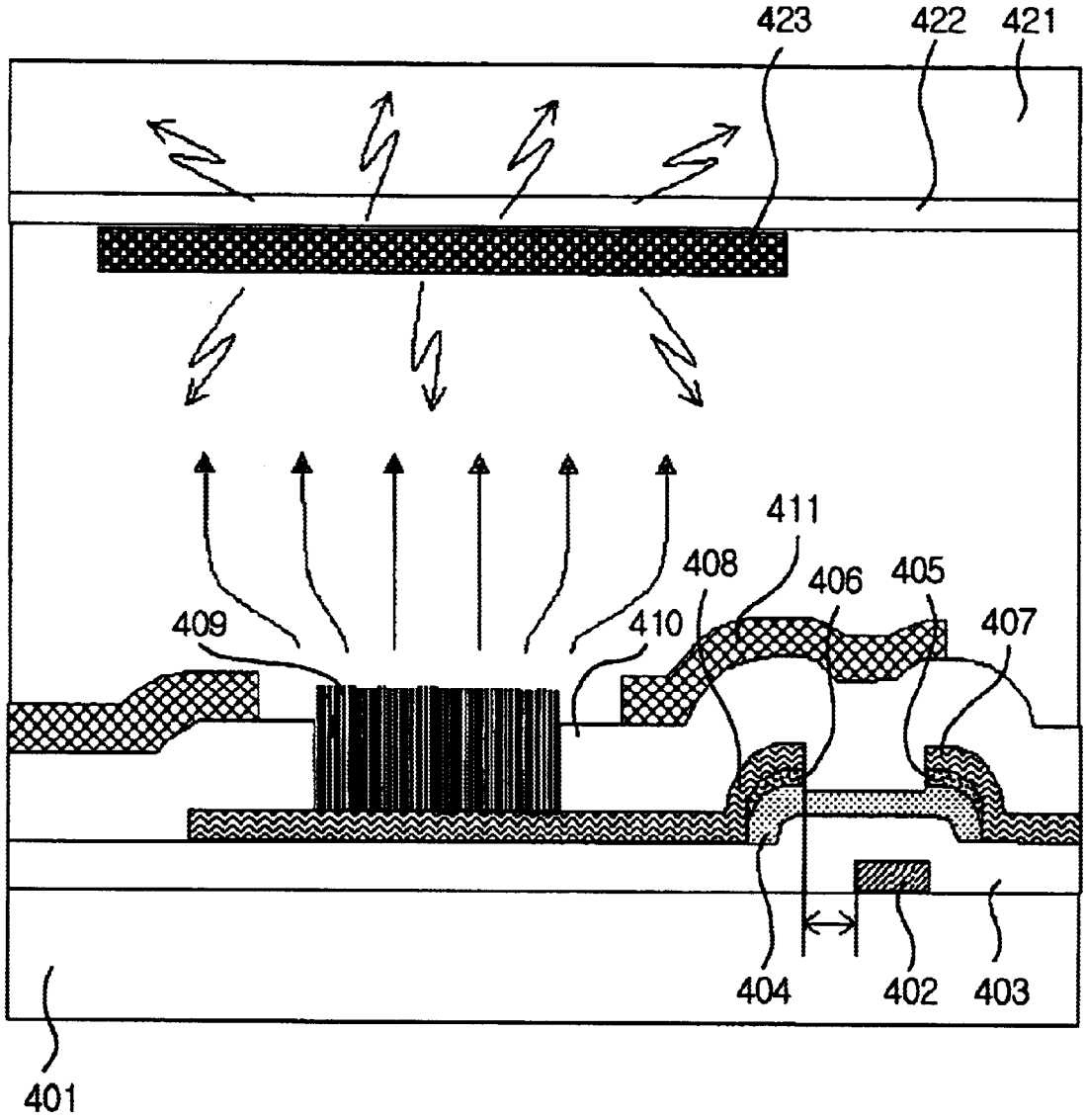
FIG. 4 is a cross-sectional view illustrating one dot pixel structure in the field emission display device according to a preferred embodiment of the present invention.

FIG. 4 is a cross-sectional view illustrating one dot pixel structure in the field emission display device according to a preferred embodiment of the present invention. Referring to FIG. 4, the field emission display device according to the present invention includes a lower plate and an upper plate. A dot pixel is arranged in the lower plate in a matrix format. The dot pixel of the lower plate includes a glass substrate 401, a gate 402 of a thin film transistor (TFT), a gate insulation layer 403 of TFT, a channel 404 of TFT, a source 405 of TFT, a drain 406 of TFT, a source electrode 407, a drain electrode 408, a field emission film 409, a passivation insulation layer 410, and an electron beam focusing electrode/light-shading film 411. The gate 402 made of a metal is formed on the glass substrate 401. The gate insulation layer 403 made of a silicon nitride ($SiN_x$) film is formed on the glass substrate 401 and the gate 402. The channel 404 made of undoped amorphous silicon is formed on some portions of the gate insulation layer 403 including the gate 402. The source 405 is made of doped amorphous silicon with n-type or p-type at one end of the channel 404, and is designed to vertically overlap with some parts of the gate 402. The drain 406 is made of doped amorphous silicon with n-type or p-type at the opposite side of the source 405, and is designed not to vertically overlap with the gate 402. The source electrode 407 made of a metal is formed on the source 405 and some portions of the gate insulation layer 403. The drain electrode 408 made of a metal is formed on the drain 406 and some portions of the gate insulation layer 403. A diode-type field emission film 409 made of carbon nanotube, diamond or diamond-like carbon, etc., is formed on some portions of the drain electrode 408. The passivation insulation layer 410 made of a silicon nitride film is formed on the source electrode 407, the channel 404, the drain electrode 408, some portions of the gate insulation layer 403, and a lateral surface of the diode-type field emission film 409. The electron beam focusing electrode/light-shading film 411 made of a metal is formed on some parts of the passivation insulation layer 410 so as to vertically overlap with some parts of the gate 402, the channel 404, the source electrode 407 and the drain electrode 408, and is positioned at a lateral side of the diode-type field emission film 409. The drain 406 designed not to vertically overlap with the gate 402 has an offset structure.

In addition, a dot pixel is arranged in the upper plate in a matrix format. The dot pixel of the upper plate includes a glass substrate 421, a transparent electrode 422 partially formed on the glass substrate 421, a red, green, or blue phosphor 423 partially formed on the transparent electrode 422. The lower plate and the upper plate arrange their dot pixels to make one-to-one relationship among them, and are vacuum-packaged to each other.

Figure 5:
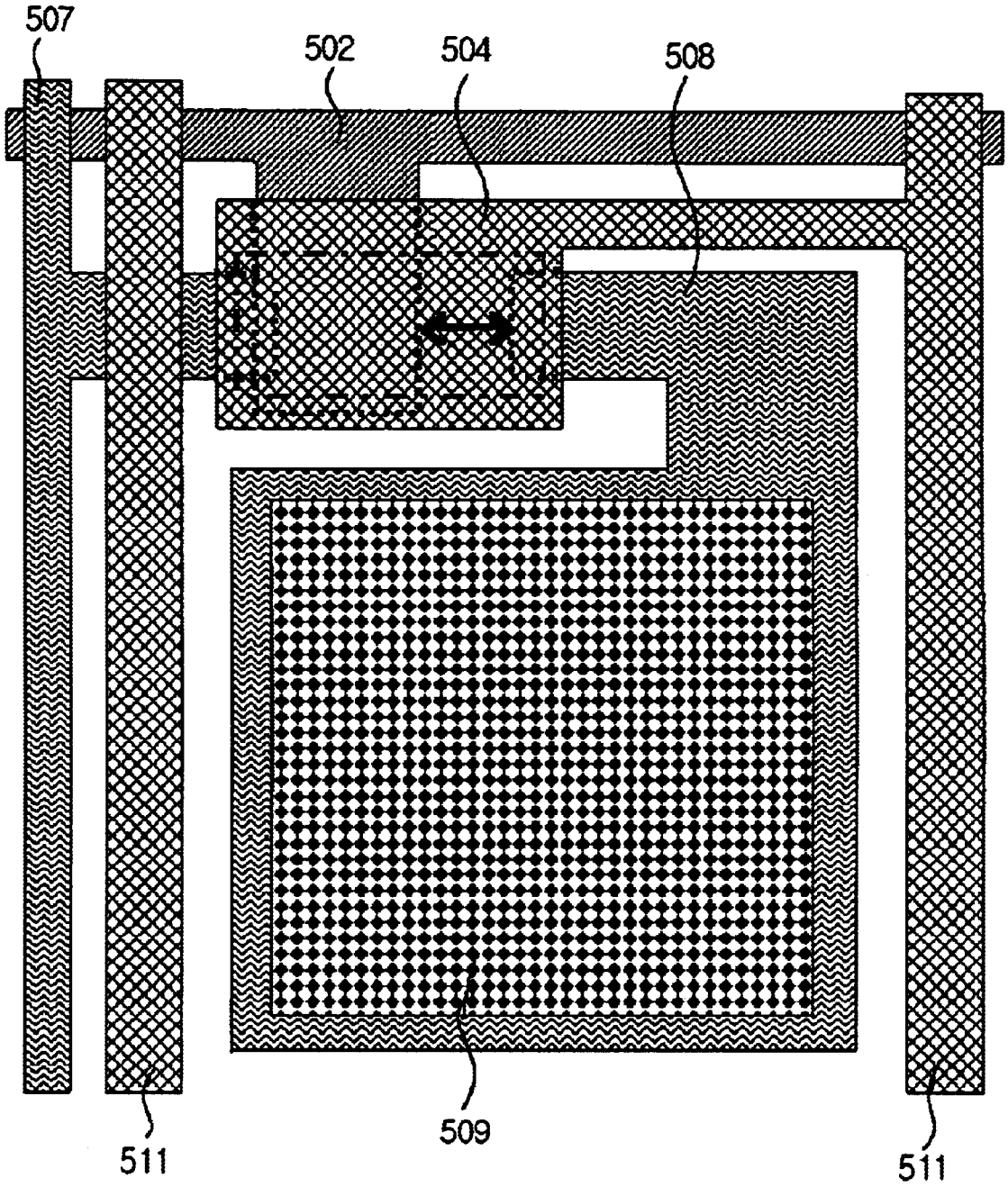
FIG. 5 is a cross-sectional view illustrating a dot pixel structure of a lower plate in the field emission display device according to a preferred embodiment of the present invention.

FIG. 5 is a cross-sectional view illustrating a dot pixel structure of a lower plate in the field emission display device according to a preferred embodiment of the present invention. Referring to FIG. 5, the electron beam focusing electrode/light-shading film 511 covers a channel 504 of a thin film transistor and is positioned on a side of a field emission film 509. Excepting this difference, other numbers shown in FIG. 5 are the same as those of FIG. 4.

Figure 6:
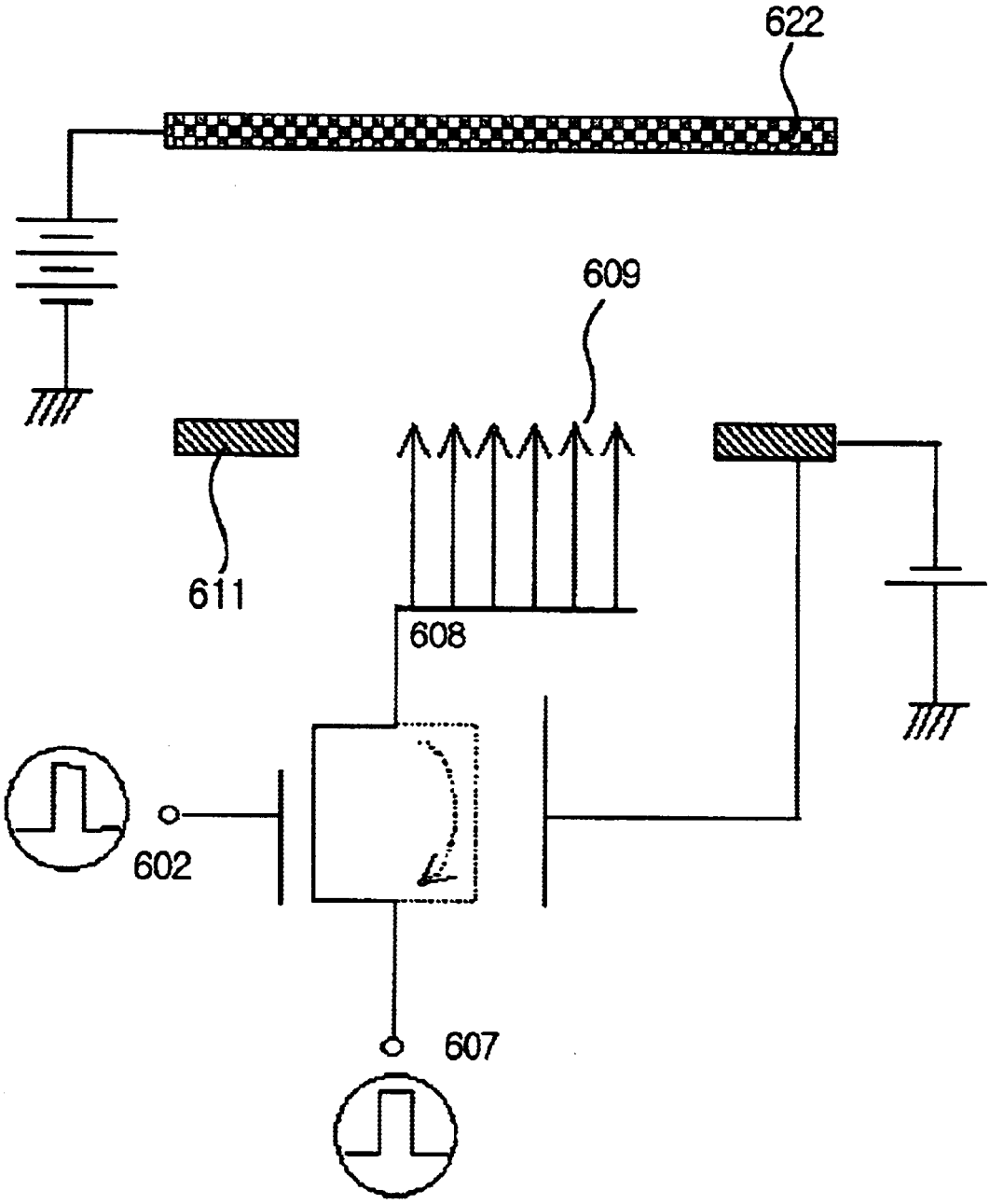
FIG. 6 is a functional diagram illustrating a driving method of the field emission display device according to a preferred embodiment of the present invention.

FIG. 6 is a functional diagram illustrating a driving method of the field emission display device according to a preferred embodiment of the present invention. Referring to FIG. 6, under the situation that a predetermined plus DC voltage is applied to a transparent electrode 622 being an anode electrode of the upper plate, a predetermined minus DC voltage is applied to the electron beam focusing electrode/light-shading film 611 of the lower plate, a scan signal and a data signal of the display device are respectively input to the gate 602 and the source electrode 607 of the thin film transistor, thereby driving the field emission display device.

When driving the field emission display device in this manner, a voltage applied on the transparent electrode 622 induces an electron emission from the field emission film 609 of the lower plate, and the electron beam focusing electrode/light-shading film 611 serves as a focusing electrode of electron beam and a shading film. The focusing electrode is used to prevent spreading of the electron beam until the electron beam emitted from the field emission film 609 arrives at the phosphor of the upper plate. The light-shading film is used to prevent that the light emitted from the phosphor of the upper plate is irradiated on the channel of the thin film transistor of the lower plate. In addition, a negative voltage applied on the electron beam focusing electrode/light-shading film 611 can be used to reduce the leakage current of the TFT's back channel area indicated as a dotted line in FIG. 6.

As described above, the high-resolution field emission display device according to the present invention can achieve an effect of focusing the electron beam path and a light-shading effect for the TFT at the same time. Therefore, the electron beam focusing effect prevents the spreading of the electron beam emitted from the field emission film until the electron beam arrives at the phosphor of the upper plate, and the light-shading effect prevents the light emitted from a fluorescent screen from being irradiated on the TFT's channel. In conclusion, the high-resolution field emission display device remarkably enhances the performance and the resolution of a field emission display.

Although representative embodiments of the present invention have been disclosed for illustrative purposes, those who are skilled in the art will appreciate that various modifications, additions and substitutions are possible without departing from the scope and spirit of the present invention as defined in the accompanying claims and the equivalents thereof.

What we claim:

1. A field emission display, comprising: a lower plate having electron source dot pixels formed a diode type field emission film in a matrix arrangement and an upper plate having phosphor dot pixels, the lower plate and the upper plate being vacuum packaged in parallel positions, and including a transistor for driving field emission of each electron source dot pixel; and an electron beam focusing electrode/light-shading film arranged to partially enclose the region of the lower plate where the field emission film is formed, and focusing the electron beam emitted from the electron source dot pixel so as to accurately direct the electron beam to the phosphor dot pixel in the upper plate, and preventing the light emitted from the phosphor of the upper plate from being irradiated on a channel of the transistor of the lower plate.

2. The field emission display according to claim 1, wherein:

the transistor is formed on the position of the lower plate outside the region where the filed emission film is formed; and the electron beam focusing electrode/light-shading film covers the upper surface of the transistor, and serves as a shading film for preventing the light emitted from the phosphor of the upper plate from being irradiated on the transistor.

3. The field emission display according to claim 1, wherein the transistor comprises:

a gate made of a metal thin film formed on a part of the lower plate;

a gate insulation layer made of a silicon nitride film deposited on the lower plate including the gate;

a channel made of amorphous silicon deposited on the gate insulation layer and positioned over at least a part of the gate;

a source made of doped amorphous silicon deposited on the channel and positioned over at least a part of the gate;

a drain made of doped amorphous silicon deposited on the channel and having a lateral side opposing a lateral side of the source and positioned at a location offset from the gate in a lateral direction;

a source electrode made of a metal thin film deposited on the source; and a drain electrode made of a metal thin film deposited on the drain, wherein the drain electrode is extended to provide a substrate for forming the electron source dot pixel, and is deposited on the lower plate.

4. The field emission display according to claim 3, wherein the transistor is a high-voltage amorphous silicon thin film transistor having an offset structure between the gate and the drain.

5. The field emission display according to claim 3, wherein the diode type field emission film is made of carbon nanotube.

6. The field emission display according to claim 3, wherein the diode type field emission film is made of diamond.

7. The field emission display according to claim 3, wherein the diode type field emission film is made of diamond-like carbon.

8. The field emission display according to claim 1, wherein, when a predetermined plus (+) DC voltage is applied to the transparent electrode of the upper plate, a predetermined minus (–) DC voltage is applied to the electron beam focusing electrode/light-shading film of the lower plate, thereby driving a display operation.

9. The field emission display according to claim 1, wherein the electron beam focusing electrode/light-shading film is made of a metal.

10. The field emission display according to claim 3, further comprising:

a passivation insulation layer made of a silicon nitride film, which is partially deposited on the source, the drain, the source electrode and the drain electrode; and a metal electrode which is deposited on at least a portion of the circumference of the field emission film region, and on at least a portion of the passivation insulation layer.

* * * * *